United States Patent [19]

Miyoshi et al.

[11] Patent Number: 4,870,463

[45] Date of Patent: Sep. 26, 1989

[54] LATENT ELECTROSTATIC IMAGE DEVELOPING DEVICE AND TONER CARTRIDGE

[75] Inventors: Yoshitake Miyoshi, Souraku; Kiyotaka Shibata, Takatsuki, both of Japan

[73] Assignee: Mita Industrial Co., Ltd., Osaka, Japan

[21] Appl. No.: 156,877

[22] Filed: Feb. 18, 1988

[30] Foreign Application Priority Data

Mar. 2, 1987 [JP] Japan ..... 62-30158
Jun. 26, 1987 [JP] Japan ..... 62-98219

[51] Int. Cl.[4] ..... G03G 15/08

[52] U.S. Cl. ..... 118/653; 118/658; 222/DIG. 1; 355/260

[58] Field of Search ..... 355/3 DD; 222/325, DIG. 1, 222/561; 221/197, 287; 206/527, 604, 634, 633; 141/319, 320, 321, 322, 363, 364, 365, 366; 118/653, 657, 658

[56] References Cited

U.S. PATENT DOCUMENTS

| | | | |
|---|---|---|---|
| 2,904,000 | 9/1959 | Fisher et al. | 118/657 |
| 3,339,807 | 9/1967 | Eichorn | 222/171 |
| 3,618,826 | 11/1971 | Carlson et al. | 222/166 |
| 3,999,654 | 12/1976 | Pollack | 222/DIG. 1 X |
| 4,062,385 | 12/1977 | Katusha et al. | 141/89 |
| 4,456,154 | 6/1984 | Herriman | 141/363 X |
| 4,491,161 | 1/1985 | Tamura et al. | 355/3 DD X |
| 4,650,070 | 3/1987 | Oka et al. | 206/633 X |

FOREIGN PATENT DOCUMENTS

| | | | |
|---|---|---|---|
| 0101303 | 8/1983 | European Pat. Off. . | |
| 0102002 | 8/1983 | European Pat. Off. . | |
| 0170760 | 8/1986 | Japan | 355/3 DD |

OTHER PUBLICATIONS

Japanese Patent Abstract, vol. 10, No. 380(P-528) [2437] Dec. 19, 1986, (just abstract).

*Primary Examiner*—A. T. Grimley
*Assistant Examiner*—Robert Beatty
*Attorney, Agent, or Firm*—Antonelli, Terry & Wands

[57] ABSTRACT

A latent electrostatic image developing device, including a cartridge loading section having an open top and a toner cartridge adapted to be removably loaded into the cartridge loading section. The cartridge loading section includes a pair of upwardly facing supporting shoulder surfaces extending longitudinally in laterally spaced-apart relationhsip, guiding side surfaces rising respectively from the outside edges of the shoulder surfaces, and a guiding rear surface extending between the rear ends of the guiding side surfaces. The guiding side surfaces respectively having holding protrusions provided at their front end portions. Engaging protrusions are provided behind of the holding protrusions at a predetermined distance therefrom. The toner cartridge includes a loading flange having side flange portions disposed in correspondence to the pair of shoulder surfaces and a closing member extending above the loading flange while surrounding both sides and the rear end thereof. The closing member is formed of a flexible material such as sponge rubber and extends beyond the outside edge of the loading flange.

17 Claims, 4 Drawing Sheets

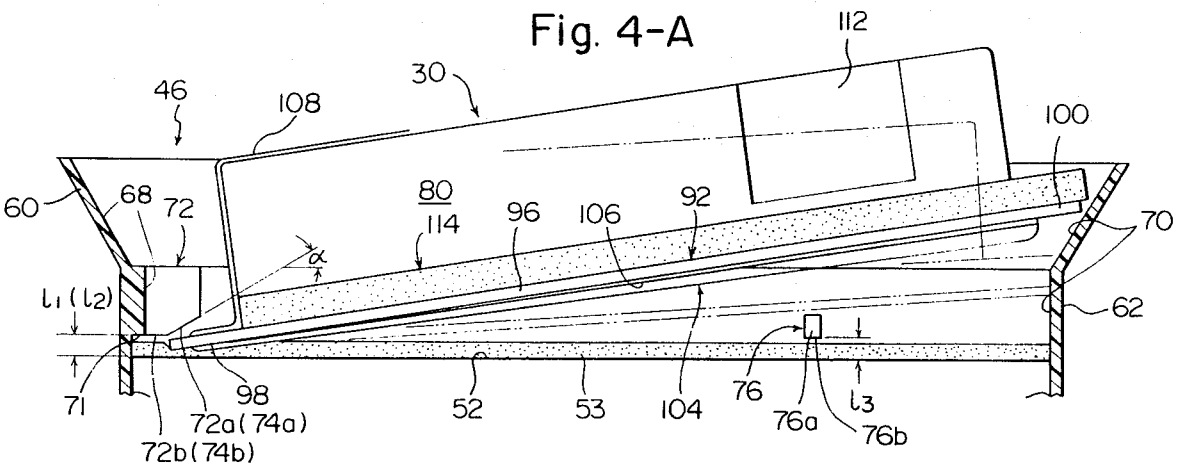
Fig. 4-A
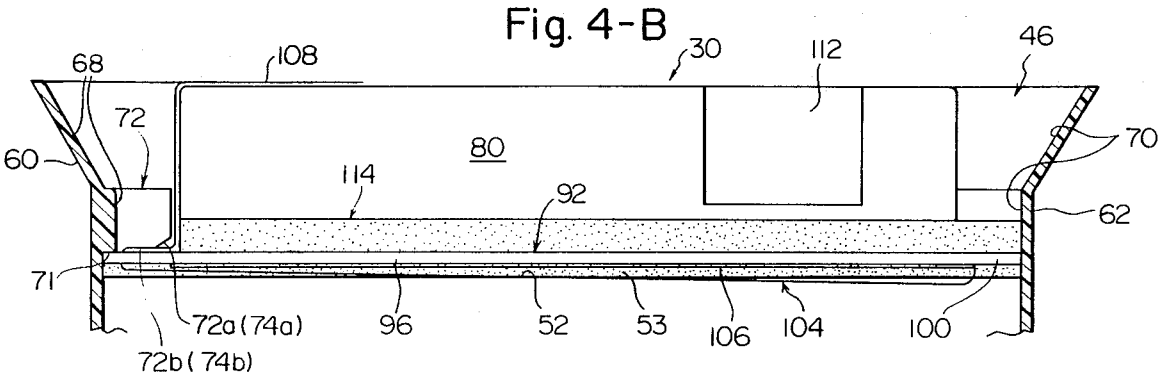
Fig. 4-B

LATENT ELECTROSTATIC IMAGE DEVELOPING DEVICE AND TONER CARTRIDGE

FIELD OF THE INVENTION

This invention relates to a latent electrostatic image developing device to be installed in an image-forming machine such as an electrostatic copying machine and an electrostatic printing machine, and to a toner cartridge to be used in the latent electrostatic image developing device.

DESCRIPTION OF THE PRIOR ART

It is known that a latent electrostatic image developing device for developing a latent electrostatic image to a toner image is installed in an image-forming machine such as a latent electrostatic copying machine or an electrostatic printing machine. One type of the latent electrostatic image developing device in widespread commercial acceptance uses a toner cartridge for supplying a toner to be consumed.

In a typical example of the above type of latent electrostatic image developing device, a cartridge loading section having an open top is provided and a box-like toner cartridge containing a toner is removably loaded into the cartridge loading section through the opening at its top, as disclosed in Japanese Laid-Open Utility Model Publication No. 104850/1985 and Japanese Laid-Open Patent Publication No. 170760/1986.

The conventional latent electrostatic image developing devices, however, have one or more problems to be solved. Such problems include:

(a) a structure for maintaining a cartridge exactly at a required position in the cartridge loading section is relatively complex and expensive;

(b) the operation of loading or unloading the toner cartridge into or from the cartridge loading section is not entirely easy; and, (c) at the time of loading or unloading the cartridge into or from the cartridge loading section, the remaining toner may possibly scatter and soil the operator's clothing.

SUMMARY OF THE INVENTION

It is an object of this invention to provide a relatively simple and inexpensive structure for holding a toner cartridge exactly at a required position of a cartridge loading section by improving the cartridge loading section and/or the toner cartridge.

Another object of this invention is to enable loading and unloading of a toner cartridge quite easily into and from a cartridge loading section by improving the cartridge loading section and/or the toner cartridge.

Still another object of this invention is to sufficiently prevent the remaining toner from scattering from a cartridge loading section at the time of loading and unloading a toner cartridge into and from the cartridge loading section by improving the cartridge loading section and/or the toner cartridge.

In a specific aspect of this invention, the cartridge loading section, having an open top, is provided with a pair of upwardly facing supporting shoulder surfaces extending longitudinally in laterally spaced-apart relationship, guiding side surfaces rising respectively from the outside edges of the shoulder surfaces, and a guiding rear surface extending between the rear ends of the guiding side surfaces, and holding protrusions are provided respectively in the front end portions of the guiding side surfaces. Furthermore, engaging protrusions are provided behind the holding protrusions, at a predetermined distance therefrom.

The toner cartridge is provided with a loading flange having side flange portions disposed correspondingly to the pair of shoulder surfaces, and a closing member surrounding the two sides and rear end of the cartridge and extending above the loading flange. The closing member is formed of a flexible material and extends beyond the outside edge of the loading flange.

The toner cartridge is loaded unloadably into the cartridge loading section by inclining the toner cartridge downwardly toward its front end and in this state, inserting the front end portion of the loading flange between the shoulder surfaces and the holding protrusions in the cartridge loading section, and then lowering the rear end of the toner cartridge so that the side flange portions of the loading flange pass elastically over the holding protrusions in the cartridge loading section. To unload the toner cartridge from the cartridge loading section, the above procedure is carried out in the reverse order.

Prior to the elastic passage of the side flanges over the holding protrusions in the above loading operation, the closing member is brought into intimate contact with the guiding side surfaces and the guiding rear surface of the cartridge loading section, thereby preventing the remaining toner from scattering out of the cartridge loading section.

Other objects of this invention, along with its advantage, will become apparent from the following detailed description taken in conjunction with the accompanying drawings.

BRIEF DESCRIPTION OF THE DRAWINGS

FIGS. 4-A and 4-B are sectional views for illustrating the manner of loading the toner cartridge into the cartridge loading section in the developing device shown in FIG. 1.

DETAILED DESCRIPTION OF PREFERRED EMBODIMENTS

Preferred embodiments of the invention will now be described in detail with reference to the accompanying drawings.

Figure 1:
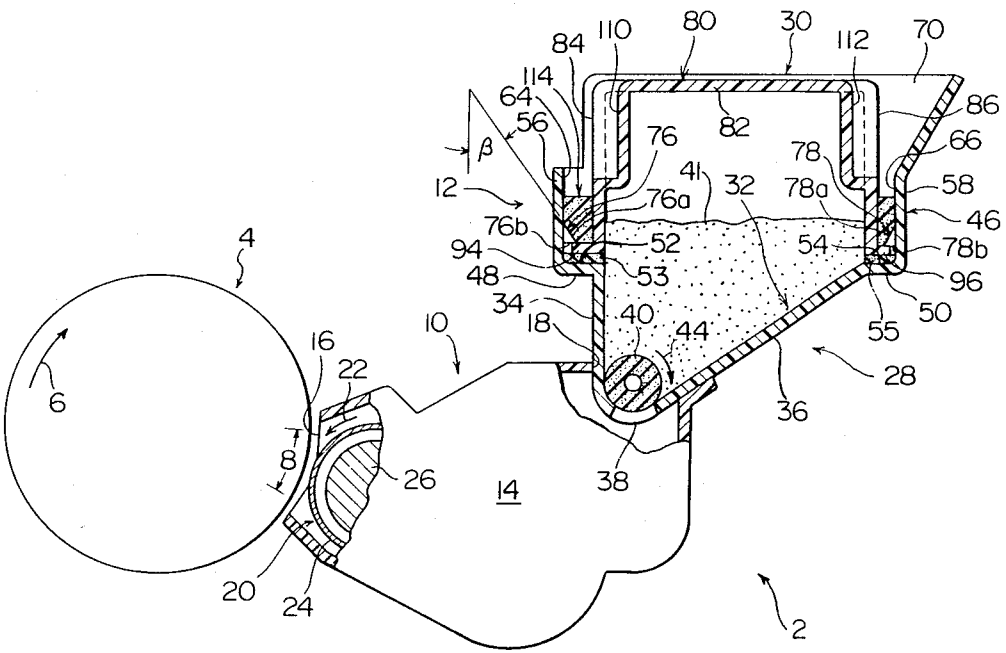
FIG. 1 is a sectional view of one embodiment of the latent electrostatic image developing device constructed in accordance with this invention.

With reference to FIG. 1, the latent electrostatic image developing device of the invention shown generally at 2 is provided in relation to a rotating drum 4 in an image-forming machine such as an electrostatic copying machine or an electrostatic printing machine. The rotating drum 4 has a photosensitive material on its peripheral surface, and is adapted to rotate in the direction shown by an arrow 6. A latent electrostatic image is formed on the peripheral surface of the rotating drum 4 by a known method and, in a developing zone shown by numeral 8, is developed to a toner image by developing device 2. The developed toner image on the rotating drum 4 is transferred to a suitable sheet such as paper and then fixed to it by known methods.

The developing device 2 is comprised of a main portion 10 and a toner supply portion 12. The main portion 10 is provided with a development receptacle 14 having a development opening 16 formed opposite to the rotating drum 4 and a toner supply opening 18 formed in the top right end part of the receptacle 14 in FIG. 1. A two-component developer composed of carrier particles and a toner is held in the development receptacle 14. A magnetic brush-type developer applicator 20 is disposed within the development receptacle 14. The applicator 20, which may be comprised of a sleeve 24 to be rotated in the direction shown by an arrow 22 and a stationary permanent magnet 26 disposed within the sleeve 24, magnetically attracts the developer onto its surface, carries it to the developing zone 8, and applies it to the surface of the rotating drum 4. The development receptacle 14 also include therein agitating means, for agitating the developer, and developer regulating means, for controlling the thickness of a layer of the developer attracted to the peripheral surface of the applicator 20 and carried to the developing zone 8 although these additional elements are not shown in the drawings. Since the structure of the main portion 10 of the developing device 2 is known, a detailed description of the main portion 10 is omitted herein.

The toner supply portion 12 of the developing device 2 is comprised of a toner hopper 28 and a toner cartridge 30 to be mounted detachably on the toner hopper 28. The toner hopper 28 has a hopper receptacle 32 that can be molded from a suitable synthetic resin. The lower portion of the hopper receptacle 32 has a left side wall 34 extending substantially vertically and a right side wall 36 extending downwardly and inclined to the left in FIG. 1. The lower end portion of the hopper receptacle 32 is permitted to advance into the development receptacle 14 through the toner supply opening 18 formed in the receptacle 14. An elongate toner discharge opening 38 extending in the front-rear direction (the direction perpendicular to the sheet surface in FIG. 1) is formed in the lower end portion of the hopper receptacle 32. In relation to the toner discharge opening 38, a toner discharging roller 40, which is known per se and which may be formed of sponge rubber, is rotatably installed within the lower end portion of the hopper receptacle 32. The toner discharging roller 40 extends along and above the toner discharge opening, 38. When the toner discharge roller 40 is not in motion, the toner 41 is not supplied to the development receptacle 14 from the hopper receptacle 32. However, the toner discharging roller 40 is rotated in the direction shown by an arrow 44 by a driving source, which may be an electric motor 42 (FIG. 2) fixed to the lower part of the rear surface of the hopper receptacle 32, the toner 41 in the hopper receptacle 32 adheres to the surface of the toner discharging roller 40 and is carried to the toner discharge opening 38 and then supplied to the development receptacle 14.

Figure 2:
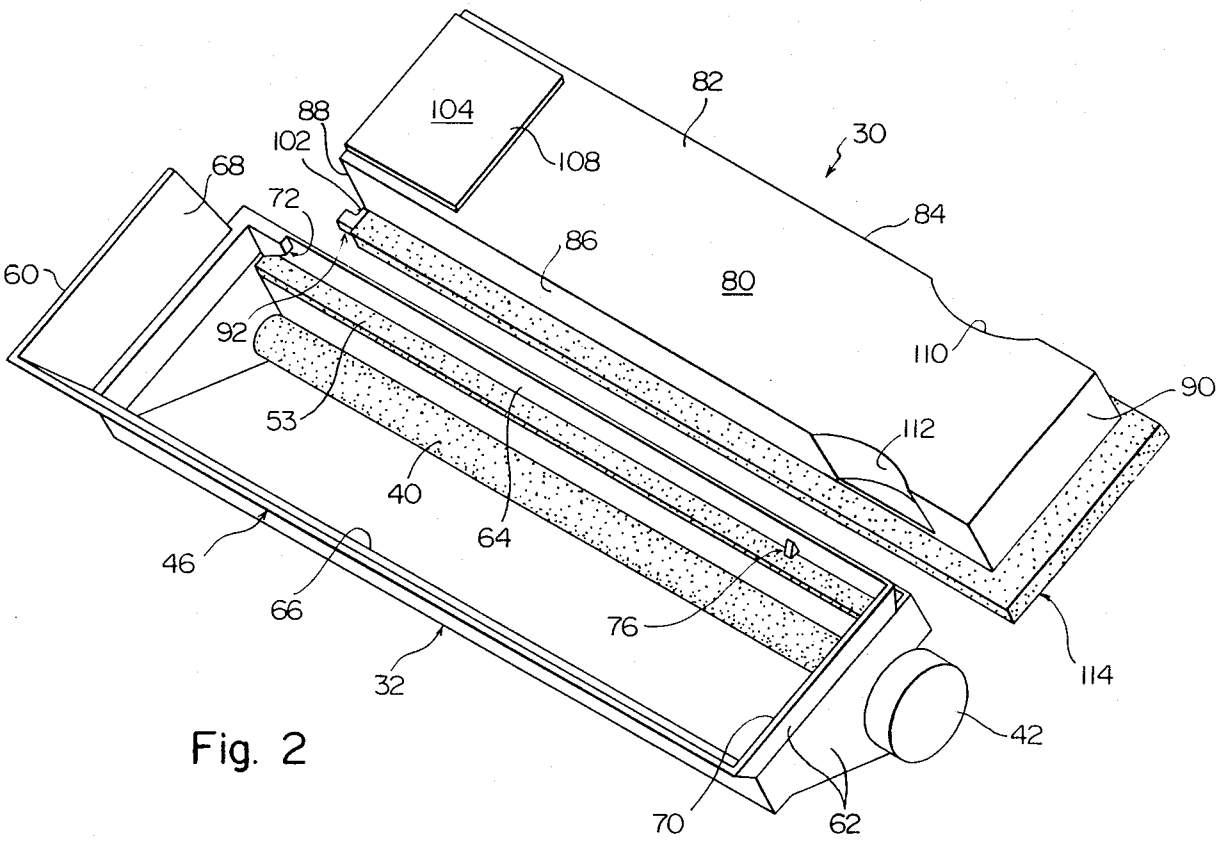
FIG. 2 is an exploded perspective view showing a cartridge loading section and a toner cartridge in the developing device shown in FIG. 1.

A cartridge loading section 46 having an open top is disposed in the upper part of the hopper receptacle 32, and the toner cartridge 30 is removably loaded into the cartridge loading section 46 through its open top. With reference to FIG. 2 as well as FIG. 1, the hopper receptacle 32 has formed therein a left shoulder wall 48, projecting substantially horizontally to the left in FIG. 1 from the upper end of its left side wall 34, and a right shoulder wall 50, projecting substantially horizontally to the right in FIG. 1 from the upper end of its right side wall 36. The upper surfaces of the left and right shoulder walls 48 and 50 constitute a pair of upwardly facing supporting shoulder surfaces 52 and 54 extending substantially parallel to each other and longitudinally (in the front-rear direction) in laterally spaced-apart relationship. Push-up members 53 and 55 formed of a flexible material, preferably sponge rubber, are bonded to the supporting shoulder surfaces 52 and 54. Furthermore, in the hopper receptacle 32, a left guiding wall 56 and a right guiding wall 58 are formed which respectively rise from the outside ends of the left and right shoulder walls 48 and 50. Also, a front wall 60 and a rear wall 62 extend upwardly beyond the supporting shoulder surfaces 52 and 54. It will be easily appreciated by reference to FIG. 3 in conjunction with FIGS. 1 and 2 that the left guiding wall 56 extends upwardly in a substantially vertical dirction from the left shoulder wall 48, and the right guiding wall 58 extends upwardly in a substantially vertical direction from the right shoulder wall 50 in correspondence to the left guiding wall 56 and then extends upwardly while being inclined outwardly (to the right in FIG. 1). Accordingly, the inside surface of the left guiding wall 56 defines a left guiding side surface 64 rising substantially vertically from the outside edge of the supporting shoulder surface 52, and the inside surface of the right guiding wall 58 defines a right guiding side surface 66 rising substantially vertically from the outside edge of the supporting shoulder surface 54 and then extending upwardly while being inclined outwardly. The front wall 60 and the rear wall 62 of the hopper receptacle 32, in correspondence to the right guiding wall 58, also extend upwardly in a substantially vertical direction beyond the supporting shoulder surfaces 52 and 54, and then extend upwardly while being inclined forwardly and rearwardly, respectively. The inside surfaces of those parts of the front wall 60 and the rear wall 62 which extend upwardly beyond the supporting shoulder surfaces 52 and 54 define a guiding front surface 68 and a guiding rear surface 70. As is clearly depicted in FIGS. 4-A and 4-B, a substantially vertically extending main portion of the guiding front surface 68, excepting its lower end part, extends rearwardly and thus has a large thickness. Thus, an engaging lower surface 71 spaced from the supporting shoulder surfaces 52 and 54 a predetermined distance ($l_1$) (FIG. 4-A) is formed in the guiding front surface 68.

Figure 3:
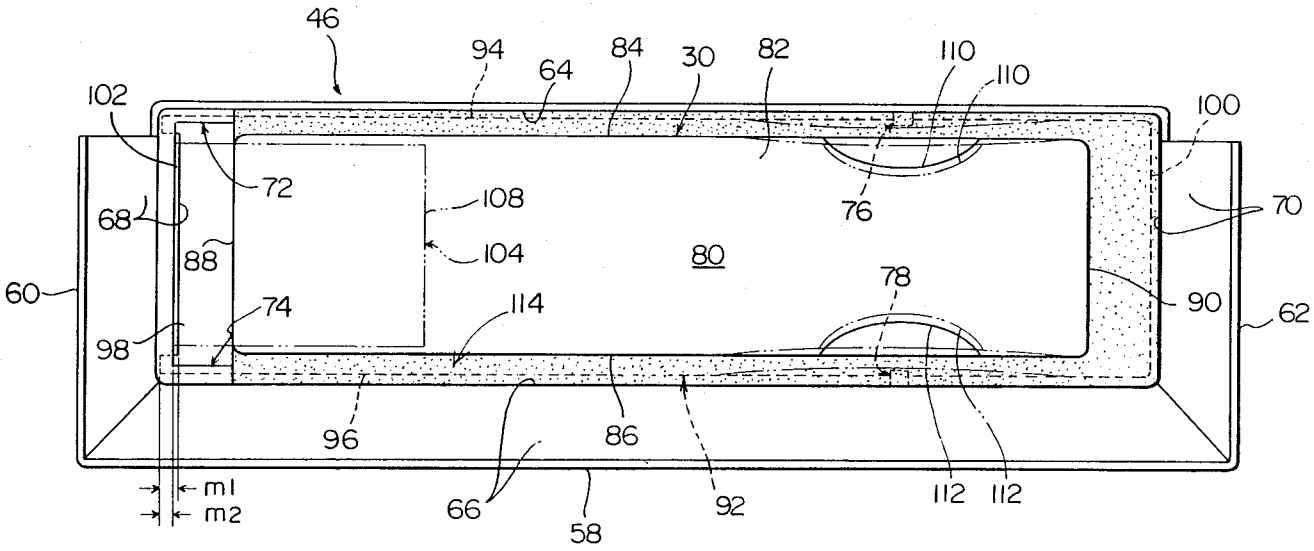
FIG. 3 is a top plan view showing the cartridge loading section and the toner cartridge in the developing device shown in FIG. 1.

With reference to FIGS. 4-A and 4-B taken in conjunction with FIGS. 2 and 3, holding protrusions 72 and 74 are formed at corresponding positions in the front end portions of the left guiding side surface 64 and the right guiding side surface 66. The holding protrusions 72 and 74 respectively have introduction lower surfaces 72*a* and 74*a* inclined downwardly in the front direction and holding lower surfaces 72*b* and 74*b* extending forwardly in a substantially horizontal direction from the front ends of the introduction lower surfaces 72*a* and 74*a*. The angle of inclination, $\alpha$, (FIG. 4-A) of the introduction lower surfaces 72*a* and 74*a* may be about 30 to 60 degrees. The distance from the holding lower surfaces 72*b* and 74*b* to the supporting shoulder surfaces 52 and 54 is set at a predetermined value $l_2$ (FIG. 4-A) which may be substantially equal to the above predetermined value $l_1$. Hence, the holding lower surfaces 72*b* and 74*b* and the engaging lower surface 71 formed in the guiding front surface 68 are in the same plane. In the left guiding side surface 64 and the right guiding side surface 66, engaging protrusions 76 and 78 are formed behind of the holding protrusions 72 and 74 respectively and a predetermined distance therefrom. The engaging protrusions 76 and 78 respectively have introduction inside surface 76*a* and 78*a*, extending downwardly and inclined laterally inwardly, and engaging lower surfaces 76*b* and 78*b*, extending substantially horizontally and laterally outwardly from the lower ends of the introduction inside surfaces 76*a* and 78*a*. The angle of inclination, $\beta$, (FIG. 1) of the introduction inside surfaces 76*a* and 78*a* may be about 20 to 40 degrees. The distance from the engaging lower surfaces 76*b* and 78*b* to the supporting shoulder surfaces 52 and 54 is set at a predetermined value $l_3$ (FIG. 4-A) which may be equal to the predetermined values $l_1$ and $l_2$.

With reference to FIGS. 1 and 2, the toner cartridge 30 will be described in detail. The illustrated toner cartridge 30 is provided with a box-like main portion 80 which may be molded from a suitable synthetic resin. The box-like main portion 80 has a rectangular upper wall 82 which is slender in the front-rear direction, a left and a right side wall 84 and 86 extending downwardly from the two side edges of the upper wall 82, and a front and a rear wall 88 and 90 extending downwardly from the front and rear edges of the upper wall 82. A loading flange 92 is disposed on the periphery of the lower end of the main portion 80. It will be appreciated by reference to FIGS. 3, 4-A and 4-B that the loading flange in the illustrated embodiment has a left and a right flange portion 94 and 96 bulging substantially horizontally and laterally outwardly from the lower ends of the left and right side walls 84 and 86 of the box-like main portion 80, and a front and a rear flange portion 98 and 100 extending substantially horizontally in the forward and rearward directions from the lower ends of the front and rear walls 88 and 90 of the main portion 80. The distance between the outside edges of the left and right flange portions 94 and 96 is substantially equal to, or slightly smaller than, the distance between the left and right guiding side surfaces 64 and 66 in the cartridge loading section 46. The distance between the front and vertical rear flange portions 98 and 100 corresponds to the distance between the vertical guiding front and rear surfaces 68 and 70 in the cartridge loading section 46. The thickness of the loading flange 92 is slightly smaller than the predetermined value $l_1$, $l_2$, and $l_3$ in the cartridge loading section 46. As shown in FIGS. 2 and 3, a rectangular notch 102, having a slightly larger width than the width of the box-like main portion 80, is formed in the front flange portion 98 of the loading flange 92. The size $m_1$ of this notch 102 in the front-rear direction is set at a value slightly larger than the depth $m_2$ (FIG. 3) in the front-rear direction of the engaging lower surface 71 formed in the guiding front surface 68 of the cartridge loading section 46.

Toner is filled in the box-like main portion 80 through its open lower surface, and then the lower surface of the main portion 80 is releasably sealed up by a sealing member 104. As can be seen by reference to FIG. 4-A, the sealing member 104, which is known per se and may be formed of a synthetic resin film, has a sealing portion 106, which extends from the front end to the rear end of the box-like main portion 80 and covers the lower surface, and an extension 108, extending further from the sealing portion 106. The sealing portion 106 is releasably bonded to the lower surface of the loading flange 92. The extension 108 of the sealing member 104 is folded over the sealing portion 106, and extends forwardly along the lower surface of the box-like main portion 80, then upwardly through the notch 102 formed in the front flange portion 98 and along the front wall 88 of the main portion 80, and further rearwardly along the upper wall 82 of the main portion 80. The free end of the extension 108 is removably anchored on the upper wall 82 of the main portion 80 by suitable means.

With reference to FIG. 2, in the toner cartridge 30 provided by this invention, finger-hooking depressed portions 110 and 112 are provided at predetermined positions of the left and right side walls 84 and 86 of the box-like main portion 80. The positions of these depressed portions 110 and 112 in the front-rear direction correspond to the positions of the engaging protrusions 76 and 78 of the cartridge loading section 46 in the front-rear direction. A closing member 114 is disposed on the peripheral surface of the box-like main portion 80 in the illustrated toner cartridge 30. The closing member 114 is formed of a flexible material such as sponge rubber, and extends continuously over the outside surfaces of the left side wall 84, rear wall 90 and right side wall 86. If desired, the closing member 114 may be allowed to extend also over the outside surface of the front wall 88 of the main portion 80. The closing member 114 is positioned above the loading flange 92 and extends slightly outwardly beyond the outside edge of the loading flange 92. The closing member 114 may be bonded to the outside surfaces of the left side wall 84, rear wall 90 and right side wall 86 of the box-like main portion 80 with its lower end in contact with the upper surface of the loading flange 92 or spaced upwardly a little from the loading flange 92. Alternatively, the closing member 114 may be bonded to the upper surfaces of the left flange portion 94, rear flange portion 100 and right flange portion 96 of the loading flange 92.

With reference mainly to FIGS. 4-A and 4-B, the manner of loading the toner cartridge 30 into the cartridge loading section 46 and the manner of unloading it from the loading section 46 will be described.

In loading the toner cartridge 30 into the cartridge loading section 46, the toner cartridge 30 is inclined downwardly toward its front end and in this state carried into the cartridge loading section 46 as shown in FIG. 4-A. The front ends of the left and right flange portions 94 and 96 of the loading flange 92 are placed on the supporting shoulder surfaces 52 and 54 of the cartridge loading section 46, and more specifically on the push-up members 53 and 55 bonded thereto. Then, the toner cartridge 30 is moved forwardly and at the same time, its rear end is lowered. It will be easily understood by reference to FIGS. 4-A and 4-B that when the toner cartridge 30 is moved forwardly, the front end portions of the left and right flange portions 94 and 96 move on the push-up members 53 and 55, bonded to the supporting shoulder surfaces 52 and 54, and while being guided by the introduction lower surfaces 72*a* and 74*a* of the holding protrusions 72 and 74, advance beneath the holding lower surfaces 72*b* and 74*b* of the holding protrusions 72 and 74 and the engaging lower surface 71 located forwardly of the holding lower surfaces 72*b* and 74*b*. On the other hand, when the rear end of the toner cartridge 30 begins to be lowered from the position shown in FIG. 4-A toward the position shown in FIG. 4-B, the closing member 114 provided on the peripheral surface of the box-like main portion 80 is first brought into intimate contact with the left and right guiding side surfaces 64 and 66 and the guiding rear surface 70 in the cartridge loading section 46, as shown by a two-dot chain line in FIG. 4-A. As a result, the front end portion of the loading flange 92 or the front wall 88 of the box-like main portion 80 in the toner cartridge 30 which has been moved forwardly in the manner described above makes contact with, or approaches, the guiding front surface 68 of the cartridge loading section 46, and the closing member 114 is brought into intimate contact with the left and right guiding side surfaces 64 and 66 and the guiding rear surface 70 of the cartridge loading section 46. Consequently, the upper surface of the cartridge loading section 46 is substantially closed by the toner cartridge 30. From then on, the remaining toner 41 in the hopper receptacle 32 for example is substantially completed prevented from scattering upwardly. When the rear end of the toner cartridge 30 continues to descend, the left and right flange portions 94 and 96 of the loading flange 92 begin to interfere with the engaging protrusions 76 and 78 of the cartridge loading section 46. As shown by a two-dot chain line in FIG. 3, owing to the elastic deformation of the left and right side walls 84 and 86 of the box-like main portion 80, the interfering sites of the left and right flange portions 94 and 96 are gradually elastically displaced inwardly in the lateral direction in some cases owing to the elastic deformation of the left and right guiding walls 56 and 58 of the cartridge loading section 46, the engaging protrusions 76 and 78 are gradually elastically displaced outwardly in the lateral direction. Accordingly, the left and right flange portions 94 and 96 pass over the introduction inner surfaces **76*a* and 78*a* of the engaging protrusions 76 and 78. When the left and right flange portions 94 and 96 have completely passed over the introduction inside surfaces 76*a* and 78*a*, the left flange portions 94 and 96 elastically return to the original state outwardly in the lateral direction. In some cases the engaging protrusions 76 and 78 elastically return to the original state inwardly in the lateral direction. Thus, the interfering sites of the left and right flange portions 94 and 96 advance beneath the engaging lower surfaces 76*b* and 78*b* of the engaging protrusions 76 and 78. When the left and right flange portions 94 and 96 abruptly return elastically to the original state after complete passage over the introduction inner surfaces 76*a* and 78*a* of the engaging protrusions 76 and 78, the hopper receptacle 32 and the toner cartridge 30 are vibrated, and an air current may occur in the hopper receptacle. However, since at this time, the upper surface of the cartridge loading section 46 is substantially closed by the toner cartridge 30, the vibration and the air current do not cause scattering of the toner 41 out of the hopper receptacle 32**.

As can be seen from FIG. 4-B, when the toner cartridge 30 is loaded into the cartridge loading section 46 as described above, the push-up members 53 and 55, bonded to the supporting shoulder surfaces 52 and 54 of the cartridge loading section 46, push up the toner cartridge 30 elastically and press it against the left and right flange portions 94 and 96 of the loading flange 92, the holding lower surfaces **72*b* and 74*b* of the holding protrusions 72 and 74, and the engaging lower surfaces 76*b* and 78*b* of the engaging protrusions 76 and 78. Thus, the toner cartridge 30 is held at the required position in the cartridge loading section 46 with sufficient stability. Furthermore, the stability of holding the toner cartridge 30 is secured more accurately because the closing member 114 of the toner cartridge 30 is elastically kept in intimate contact with the left and right guiding side surfaces 64 and 66 and the guiding rear surface 70 of the cartridge loading section 46. When the loading of the toner cartridge 30 into the cartridge loading section 46 is completed the free end portion of the extension 108 in the sealing member 104 is removed from the upper wall 82 of the box-like main portion 80, and pulled forwardly or upwardly. As a result, the sealing portion 106 of the sealing member 104 is gradually stripped from the lower surface of the box-like main portion 80, and the lower surface of the main portion 80 is opened. The sealing member 104 is thus removed from the main portion 80. When the lower surface of the main portion 80 is opened, the toner 41 in the main portion 80 falls into the hopper receptacle 32 as shown in FIG. 1**.

When the toner 41 in the hopper receptacle 32 is consumed and the toner cartridge 30 is to be unloaded from the loading section 46 to replace it with a fresh one, the first action required is to push the left and right side walls 84 and 86 of the main portion 80 inwardly in the lateral direction by hooking fingers onto the depressed portions 110 and 112 formed in the left and right side walls 84 and 86. Thus, as shown by a two-dot chain line in FIG. 3, the left and right side walls 84 and 86 are elastically deformed inwardly in the lateral direction, and the left and right flange portions 94 and 96 of the loading flange 92 are detached laterally inwardly from the engaging lower surfaces **76*b* and 78*b* of the engaging protrusions 76 and 78 of the loading section 46. The rear end portions of the toner cartridge is slightly elevated. Then, the toner cartridge 30 is moved rearwardly, and the front end portions of the left and right flange portions 94 and 96 are detached from the engaging lower surface 71 of the guiding front surface 68 and the holding lower surfaces 72*b* and 74*b* of the holding protrusions 72 and 74. After this, the cartridge 30 can be freely taken out from the cartridge loading section 46** without any restriction.

While the present invention has been described in detail with reference to one specific embodiment of the latent electrostatic image developing device constructed in accordance with this invention taken in conjunction with the accompanying drawings, it should be understood that various changes and modifications are possible without departing from the scope of the invention described and claimed herein.

For example, the illustrated latent electrostatic image developing device is of a type which uses a two-component developer composed of carrier particles and a toner. The present invention, however, can also be applied to a type of latent electrostatic image developing device which uses a one-component developer composed only of a toner. In this case, the cartridge loading section having an open top is disposed in the main portion itself of the developing device, and the toner cartridge can be detachably loaded into this cartridge loading section.

What is claimed is:

1. A latent electrostatic image developing device comprising a cartridge loading section, having an open top, and a toner cartridge removably loaded into said cartridge loading section open top, said cartridge loading section including a pair of upwardly facing supporting shoulder surfaces extending longitudinally in laterally spaced-apart relationship, a pair of guiding side surfaces rising from the outside edges of the respective shoulder surfaces, and a guiding rear surface extending between the rear ends of said guiding side surfaces, said guiding side surfaces respectively having holding protrusions provided in their front end portions and engaging protrusions provided behind said holding protrusions at a predetermined distance therefrom, said toner cartridge including a loading flange having a pair of side flange portions disposed in correspondence at least to said pair of shoulder surfaces and a closing member surrounding both sides and the rear end of said toner cartridge and extending above said loading flange, said closing member being formed of a flexible material and extending beyond the outside edge of said loading flange, said toner cartridge, when unloaded from said cartridge loading section, being adapted to be removably loaded thereinto by inclining said toner cartridge downwardly toward the front end thereof and in this state inserting the front end portion of said loading flange between said shoulder surfaces and said holding protrusions in said cartridge loading section and then lowering the rear end of said toner cartridge so that said side flange portions of said loading flange elastically pass over the respective engaging protrusions in said cartridge loading section, said closing member intimately contacting said guiding side surfaces and said guiding rear surface before said side flange portions of said loading flange pass elastically over said engaging protrusions.

2. The developing device of claim 1 wherein said holding protrusions in said cartridge loading section respectively have introduction lower surfaces inclined forwardly downwardly and holding lower surfaces extending substantially horizontally in the front direction from the front ends of said introduction lower surfaces.

3. The developing device of claim 1 wherein said engaging protrusions in said cartridge loading section respectively have introduction inside surfaces extending downwardly and inclined laterally inwardly and engaging lower surfaces extending substantially horizontally and laterally outwardly from the lower ends of said introduction inside surfaces.

4. The developing device of claim 1 wherein said cartridge loading section further includes push-up members formed of a flexible material and disposed on said shoulder surfaces of said cartridge loading section, and by the elastic action of said push-up members, said loading flange is elastically pressed against said holding protrusions and said engaging protrusions in said cartridge loading section.

5. The developing device of claim 4 wherein said push-up members are formed of sponge rubber.

6. The developing device of claim 1 wherein said toner cartridge has a pair of side walls extending from said pair of side flange portions of said loading flange, with finger-hooking depressed portions, corresponding to said engaging protrusions, provided respectively in said pair of side walls.

7. The developing device of claim 1 wherein said closing member is formed of sponge rubber.

8. A latent electrostatic image developing device comprising a cartridge loading section, having an open top, and a toner cartridge removably loaded into said cartridge loading section open top, said cartridge loading section including a pair of upwardly facing supporting shoulder surfaces extending longitudinally in laterally spaced-apart relationship, a pair of guiding side surfaces rising from the outside edges of the respective shoulder surfaces, and a guiding rear surface extending between the rear ends of said guiding side surfaces, said toner cartridge including a closing member extending while surrounding both sides and the rear end of said toner cartridge, said closing member being formed of a flexible material, said toner cartridge, when unloaded from said cartridge loading section, being adapted to be removably loaded thereinto by inclining said toner cartridge downwardly toward the front end thereof and in this state positioning the front end portion of said toner cartridge on said shoulder surfaces in said cartridge loading section and then lowering the rear end of said toner cartridge so that said closing member of said toner cartridge is brought into intimate contact with said guiding side surfaces and said guiding rear surface of said cartridge loading section and then said rear end portion of said toner cartridge is positioned on said shoulder surfaces of said cartridge loading section.

9. The developing device of claim 8 wherein said closing member is formed of sponge rubber.

10. A toner cartridge adapted to be removably loaded into a cartridge loading section of a latent electrostatic image developing device, the cartridge loading section having an open top and including a pair of upwardly facing supporting shoulder surfaces extending longitudinally in laterally spaced-apart relationship, a pair of guiding side surfaces rising from the outside edges of the respective shoulder surfaces, and a guiding rear surface extending between the rear ends of the guiding side surfaces, the guiding side surfaces respectively having holding protrusions provided in their front end portions and a pair of engaging protrusions provided behind the holding protrusions at a predetermined distance therefrom, said toner cartridge including a loading flange having a pair of side flange portions adapted to be disposed in correspondence at least to the pair of shoulder surfaces and a closing member surrounding both sides and the rear end of said toner cartridge and extending above said loading flange, said closing member being formed of a flexible material and extending beyond the outside edge of said loading flange, said toner cartridge being adapted to be removably loaded into the cartridge loading section by inclining said toner cartridge downwardly toward the front end thereof and in this state inserting the front end portion of said loading flange between the shoulder surfaces and the holding protrusions in the cartridge loading section and then lowering the rear end of said toner cartridge so that said side flange portions of said loading flange elastically pass over the respective engaging protrusions in the cartridge loading section and said closing member is brought into intimate contact with the guiding side surfaces and the guiding rear surface of the cartridge loading section and then the rear end portion of said toner cartridge is positioned on the shoulder surfaces of the cartridge loading section.

11. The toner cartridge of claim 10 further comprising a pair of side walls extending from said pair of side flange portions of said loading flange and having a pair of finger-hooking depressed portions, corresponding respectively to the pair of engaging protrusions in the cartridge loading section, disposed respectively in said pair of side walls.

12. A toner cartridge adapted to be removably loaded into a cartridge loading section of a latent electrostatic image developing device, the cartridge loading section having an open top and including a pair of upwardly facing supporting shoulder surfaces extending longitudinally in laterally spaced-apart relationship, a pair of guiding side surfaces rising from the outside edges of the respective shoulder surfaces, and a guiding rear surface extending between the rear ends of the guiding side surfaces, said toner cartridge including a closing member extending while surrounding both sides and the rear end of said toner cartridge, said closing member being formed of a flexible material, said toner cartridge being adapted to be removably loaded into the cartridge loading section by inclining said toner cartridge downwardly toward the front end thereof and in this state positioning the front end portion of said toner cartridge on the shoulder surfaces in the cartridge loading section and then lowering the rear end of said toner cartridge so that said closing member of said toner cartridge is brought into intimate contact with the guiding side surfaces and the guiding rear surface of the cartridge loading section and then said rear end portion of said toner cartridge is positioned on the shoulder surfaces of the cartridge loading section.

13. The toner cartridge of claim 12 wherein said closing member is formed of sponge rubber.

14. A toner cartridge adapted to be removably loaded into a cartridge loading section of a latent electrostatic image developing device, said toner cartridge comprising a box-like main portion having a rectangular upper wall, two side walls extending downwardly from the two side edges of said upper wall, a front and a rear wall extending downwardly from the front and rear edges of said upper wall, the lower surface of said main portion being opened, toner held in said main portion, a sealing member for releasably sealing said lower surface of said main portion, and a closing member formed of a flexible material and extending while surrounding at least the outside surfaces of said two side walls and said rear wall to intimately contact the side walls of the cartridge loading section when said toner cartridge is inserted thereinto.

15. The toner cartridge of claim 14 wherein said closing member is formed of sponge rubber.

16. The toner cartridge of claim 14 further comprising a loading flange having side flange portions extending outwardly from the lower edges of said two side walls, the closing member extending beyond the outside edge of said loading flange.

17. The toner cartridge of claim 14 wherein said two side walls have finger-hooking depressed portions disposed respectively therein.

* * * * *